US010644369B2

(12) United States Patent
Ohata et al.

(10) Patent No.: US 10,644,369 B2
(45) Date of Patent: May 5, 2020

(54) NON-RECIPROCAL CIRCUIT DEVICE AND COMMUNICATION APPARATUS USING THE SAME

(71) Applicant: TDK Corporation, Tokyo (JP)

(72) Inventors: Hidenori Ohata, Tokyo (JP); Junichi Nakamura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 113 days.

(21) Appl. No.: 15/807,347

(22) Filed: Nov. 8, 2017

(65) Prior Publication Data

US 2018/0138572 A1 May 17, 2018

(30) Foreign Application Priority Data

Nov. 14, 2016 (JP) ..... 2016-221267

(51) Int. Cl.
*H01P 1/387* (2006.01)
*H01P 1/32* (2006.01)
*H01P 1/36* (2006.01)

(52) U.S. Cl.
CPC ..... *H01P 1/32* (2013.01); *H01P 1/362* (2013.01); *H01P 1/387* (2013.01)

(58) Field of Classification Search
CPC .. H01P 1/38; H01P 1/383; H01P 1/387; H01P 1/32; H01P 1/36
USPC ..... 333/1.1, 24.2
See application file for complete search history.

(56) References Cited

U.S. PATENT DOCUMENTS

| | | | |
|---|---|---|---|
| 2005/0083146 | A1 | 4/2005 | Takeda et al. |
| 2012/0056691 | A1 | 3/2012 | Hasegawa |
| 2016/0254580 | A1 | 9/2016 | Sasaki et al. |
| 2018/0145389 | A1 | 5/2018 | Ogasawara |

FOREIGN PATENT DOCUMENTS

| | | | |
|---|---|---|---|
| EP | 0845830 | A1 | 6/1998 |
| JP | 2012-029123 | A | 2/2012 |
| JP | 2013-201684 | | 10/2013 |

*Primary Examiner* — Stephen E. Jones
(74) *Attorney, Agent, or Firm* — Young Law Firm, P.C.

(57) ABSTRACT

Disclosed herein is a non-reciprocal circuit device that includes a mounting surface substantially parallel to a stacking direction, first and second side surfaces substantially vertical to the mounting surface and substantially parallel to the stacking direction, a first permanent magnet, a magnetic rotator stacked in the stacking direction with respect to the first permanent magnet, the magnetic rotator having a central conductor and at least first and second ports derived from the central conductor, a first external terminal provided on the first side surface and connected to the first port, and a second external terminal provided on the second side surface and connected to the second port.

10 Claims, 12 Drawing Sheets

NON-RECIPROCAL CIRCUIT DEVICE AND COMMUNICATION APPARATUS USING THE SAME

BACKGROUND OF THE INVENTION

Field of the Invention

The present invention relates to a non-reciprocal circuit device and a communication apparatus using the same, and more particularly relates to a distributed constant non-reciprocal circuit device and a communication apparatus using the same.

Description of Related Art

A non-reciprocal circuit device such as an isolator and a circulator is used by being incorporated in, for example, a mobile communication apparatus such as a mobile phone and a communication apparatus used in a base station. The non-reciprocal circuit device includes a distributed constant type and a concentrated constant type. Among these types, a distributed constant non-reciprocal circuit device is suitable for an application that requires a high output such as that in a base station.

A configuration of the distributed constant non-reciprocal circuit device is described in, for example, Japanese Patent Application Laid-Open No. 2012-029123. The non-reciprocal circuit device described in Japanese Patent Application Laid-Open No. 2012-029123 has a configuration in which a central conductor having three ports extending radially with an angle of 120 degrees therebetween, and a permanent magnet that provides a magnetic field to the ferrite cores are housed in a case.

However, the non-reciprocal circuit device of a type that houses a central conductor and a permanent magnet in a case has a problem that it is difficult to realize downscaling and reduction of the manufacturing cost. Particularly, when a use in a high frequency band exceeding 20 GHz is assumed, it is required to realize considerable downscaling as compared with a non-reciprocal circuit device used in a several hundred MHz band. Therefore, it is difficult to manufacture a downscaled non-reciprocal circuit device of a type in which the central conductor and the permanent magnet are housed in a case.

Accordingly, in order to manufacture such a downscaled non-reciprocal circuit device at low cost, a multilayered non-reciprocal circuit device manufactured by using an aggregate substrate is more advantageous than the non-reciprocal circuit device housing the central conductor and the permanent magnet in a case.

FIG. 14 is a schematic perspective view showing an example of a multilayered non-reciprocal circuit device.

A non-reciprocal circuit device 100 shown in FIG. 14 includes a magnetic rotator 120 provided between two permanent magnets 111 and 112, and an external shape thereof is a substantially rectangular parallelepiped shape. The magnetic rotator 120 includes two ferrite cores 121, 122 and a central conductor 123 provided therebetween. Three ports 131 to 133 derived from the central conductor 123 are respectively connected to external terminals 141 to 143. The non-reciprocal circuit device 100 shown in FIG. 14 has a configuration in which an XY plane is a mounting surface, and the permanent magnet 111, the magnetic rotator 120, and the permanent magnet 112 are sequentially stacked in a Z direction orthogonal to the XY plane.

The non-reciprocal circuit device 100 having such a configuration can be manufactured in multiple numbers simultaneously by being stacked in a state of an aggregate substrate and then divided into plural pieces by dicing. Accordingly, the manufacturing cost can be decreased and the entire size thereof can be downscaled.

However, in the non-reciprocal circuit device 100 shown in FIG. 14, the external terminals 141 to 143 intersect the permanent magnet 111 in the Z direction. Therefore, the external terminals 141 to 143 are strongly affected by the magnetic property of the permanent magnet 111. Accordingly, inductance components of the external terminals 141 to 143 are adversely affected, thereby causing a problem that the electrical property, particularly, insertion loss deteriorates. This problem is not significant as long as a targeted frequency band is low. However, if the targeted frequency band is, for example, equal to or higher than 20 GHz, the electrical property considerably deteriorates.

SUMMARY

It is therefore an object of the present invention to improve the electrical property of a non-reciprocal circuit device that is compact and can be manufactured at low cost. Another object of the present invention is to provide a communication apparatus including such a non-reciprocal circuit device.

A non-reciprocal circuit device according to the present invention includes a mounting surface substantially parallel to a stacking direction, first and second side surfaces substantially vertical to the mounting surface and substantially parallel to the stacking direction, a first permanent magnet, a magnetic rotator stacked in the stacking direction with respect to the first permanent magnet, the magnetic rotator having a central conductor and at least first and second ports derived from the central conductor, a first external terminal provided on the first side surface and connected to the first port, and a second external terminal provided on the second side surface and connected to the second port.

A communication apparatus according to the present invention includes the non-reciprocal circuit device described above.

According to the present invention, because the mounting surface is parallel to the stacking direction, the external terminal can be arranged without intersecting the permanent magnet. According to this configuration, deterioration of the electrical property caused by overlapping of the external terminal and the permanent magnet can be prevented.

It is preferable that the non-reciprocal circuit device according to the present invention further includes a magnetic substrate, and the magnetic rotator is put between the first permanent magnet and the magnetic substrate in the stacking direction. In this case, it is more preferable that the magnetic substrate is a second permanent magnet. According to this configuration, a strong magnetic field can be applied vertically to the central conductor.

In the present invention, it is preferable that the magnetic rotator includes first and second ferrite cores that put the central conductor therebetween in the stacking direction. According to this configuration, a more preferable electrical property can be acquired.

It is preferable that the non-reciprocal circuit device according to the present invention further includes a third external terminal provided on the mounting surface, and the central conductor further includes a third port connected to the third external terminal. Accordingly, the non-reciprocal circuit device according to the present invention can be used as an isolator or a circulator having a three-port configuration. In this case, it is preferable that a part of the first and second external terminals is respectively provided on the mounting surface. According to this configuration, mounting strength and connection reliability can be increased.

In the present invention, it is preferable that an angle formed between an extending direction of the first port based on a central point of the central conductor and an extending direction of the third port based on the central point of the central conductor is an acute angle, and an angle formed between an extending direction of the second port based on the central point of the central conductor and the extending direction of the third port based on the central point of the central conductor is an acute angle. According to this configuration, because the length of the external terminal can be reduced, excellent high frequency characteristics can be acquired.

It is preferable that the non-reciprocal circuit device according to the present invention further includes a conductor plate put between the first permanent magnet and the magnetic rotator in the stacking direction, and a fourth external terminal connected to the conductor plate. According to this configuration, a reference potential such as a ground potential can be applied to the conductor plate.

It is preferable that the non-reciprocal circuit device according to the present invention further includes a connection conductor that covers an upper surface located on a side opposite to the mounting surface and connects the conductor plate to the fourth external terminal. In this case, it is preferable that the conductor plate is connected to the connection conductor by being exposed on the upper surface, without being exposed from any of the mounting surface, the first side surface, and the second side surface. According to this configuration, a short-circuit failure between the conductor plate and the external terminal can be prevented.

According to the present invention, it is possible to provide a non-reciprocal circuit device that is compact, can be manufactured at low cost and having excellent high frequency characteristics. Further, according to the present invention, it is also possible to provide a communication device including the non-reciprocal circuit device.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
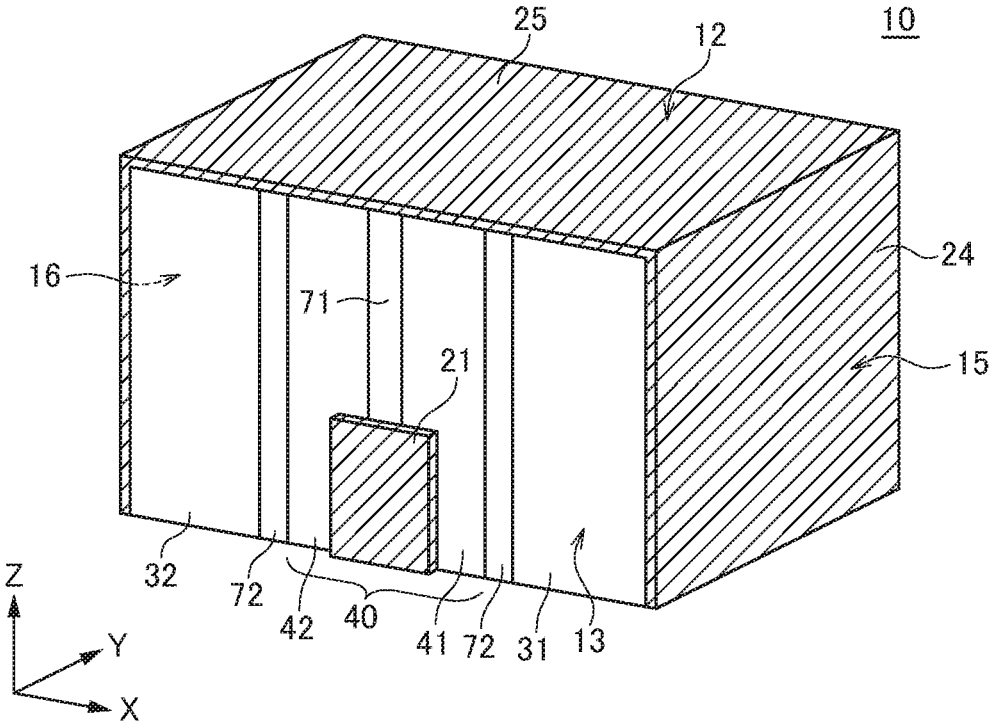
FIG. 1 is a schematic perspective view showing a configuration of a non-reciprocal circuit device according to a preferable embodiment of the present invention as viewed from an upper surface side.
Figure 2:
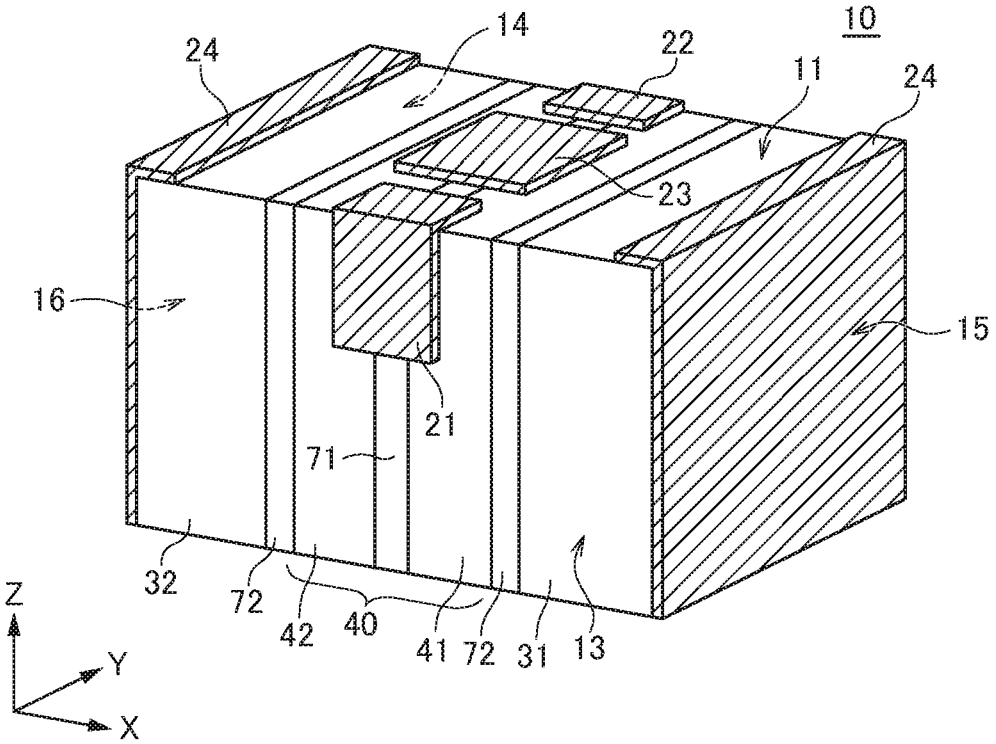
FIG. 2 is a schematic perspective view showing a configuration of the non-reciprocal circuit device according to the preferable embodiment of the present invention as viewed from a mounting surface side.
Figure 3:
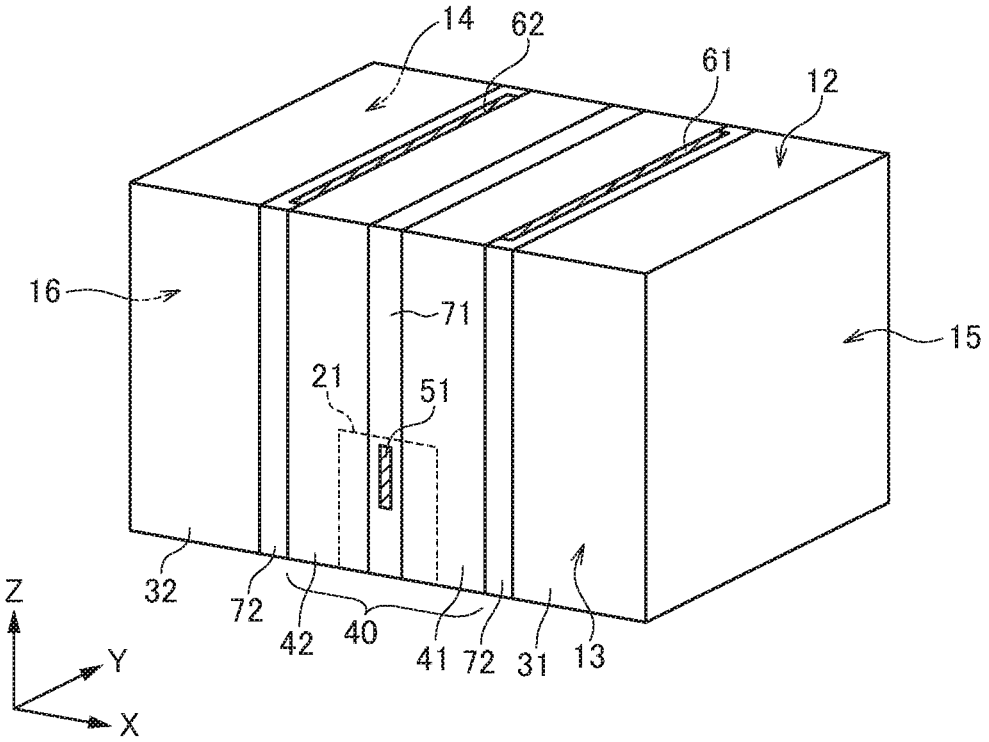
FIG. 3 is a schematic perspective view as viewed from the upper surface side showing a state in which an external terminal and a connection conductor included in the non-reciprocal circuit device are omitted.
Figure 4:
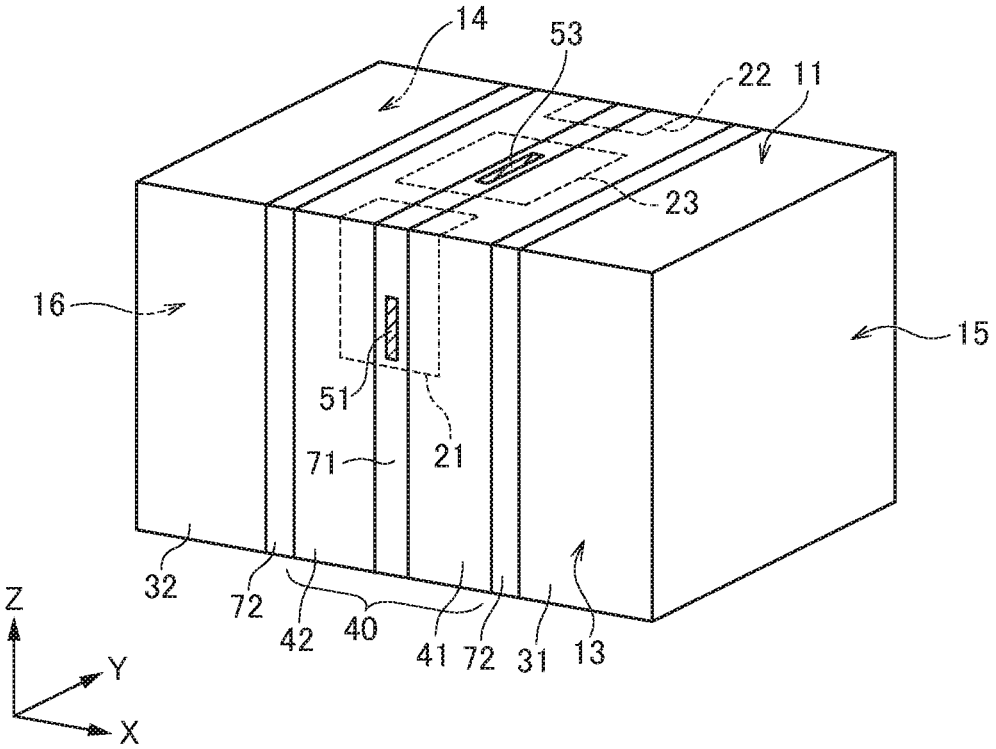
FIG. 4 is a schematic perspective view as viewed from the mounting surface side showing a state in which an external terminal and a connection conductor included in the non-reciprocal circuit device are omitted.
Figure 5:
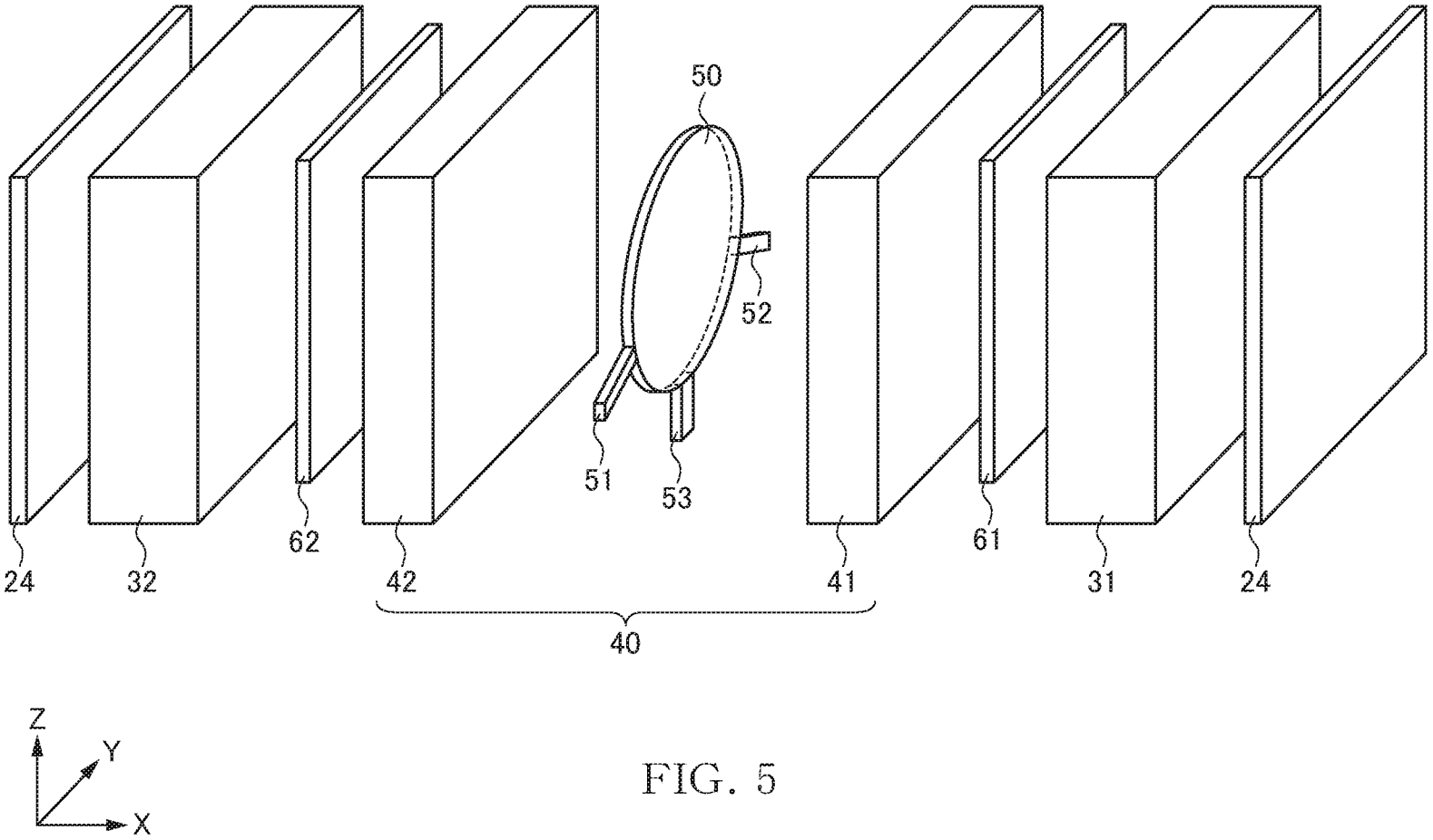
FIG. 5 is a schematic exploded perspective view for explaining a main part of the non-reciprocal circuit device.

FIGS. 1 and 2 are schematic perspective views showing a configuration of a non-reciprocal circuit device 10 according to a preferable embodiment of the present invention. FIG. 1 is a schematic perspective view as viewed from an upper surface side, and FIG. 2 is a schematic perspective view as viewed from a mounting surface side. FIGS. 3 and 4 are schematic perspective views showing a state in which an external terminal and a connection conductor included in the non-reciprocal circuit device 10 are omitted. FIG. 3 is a schematic perspective view as viewed from the upper surface side, and FIG. 4 is a schematic perspective view as viewed from the mounting surface side. FIG. 5 is a schematic exploded perspective view for explaining a main part of the non-reciprocal circuit device 10.

The non-reciprocal circuit device 10 shown in FIG. 1 to FIG. 5 is a distributed constant non-reciprocal circuit device and is incorporated in a mobile communication device such as a mobile phone and a communication device used in a base station and is used as an isolator or a circulator. Although not particularly limited thereto, it is preferable that the non-reciprocal circuit device 10 according to the present embodiment is used for a communication device used in the base station.

As shown in FIG. 1 to FIG. 5, the non-reciprocal circuit device 10 according to the present embodiment is a surface-mounted electronic component having a substantially rectangular parallelepiped shape, and includes a mounting surface 11 and an upper surface 12 forming an XY plane, first and second side surfaces 13 and 14 forming an XZ plane, and third and fourth side surfaces 15 and 16 forming a YZ plane. Although not particularly limited thereto, when a targeted frequency band is 25 GHz, the length in an X direction is about 2 millimeters, a width in a Y direction is about 1.25 millimeters, and a height in a Z direction is about 1.25 millimeters.

The non-reciprocal circuit device 10 includes four external terminals 21 to 24 and a connection conductor 25. As shown in FIG. 2, the first external terminal 21 is formed on the side surface 13 and the mounting surface 11, the second external terminal 22 is formed on the side surface 14 and the mounting surface 11, and the third external terminal 23 is formed on the mounting surface 11. In FIGS. 3 and 4, positions at which the external terminals 21 to 23 are formed are shown by a broken line. These three external terminals 21 to 23 are connected to respectively corresponding signal wirings in the case of using the non-reciprocal circuit device 10 according to the present embodiment as a circulator. On the other hand, in the case of using the non-reciprocal circuit device 10 according to the present embodiment as an isolator, for example, the external terminals 21 and 22 are connected to respectively corresponding signal wirings, and the external terminal 23 is grounded via a termination resistor. Similarly, even if the non-reciprocal circuit device 10 is grounded at a termination resistor via an end of the external terminal 21 or 22, the non-reciprocal circuit device 10 can be used as an isolator. The fourth external terminal 24 is formed on the entire side surfaces 15 and 16, and on a part of the mounting surface 11. A reference potential such as a ground potential is applied to the fourth external terminal 24. The connection conductor 25 is formed on the entire upper surface 12, and supplies a reference potential applied to the fourth external terminal 24 to a conductor plate described later.

The non-reciprocal circuit device 10 further includes permanent magnets 31 and 32, and has a configuration in which a magnetic rotator 40 is provided therebetween in the X direction, which is a stacking direction. In the present invention, one of the permanent magnets 31 and 32 can be omitted, or can be replaced by an iron plate or the like as a magnetic substrate having a small coercive force. However, in order to apply a strong magnetic field vertically to the magnetic rotator 40, it is preferable to provide the magnetic rotator 40 between the two permanent magnets 31 and 32. In the present embodiment, the external terminals 21 to 23 are formed on the surface of the magnetic rotator 40, and the external terminals 21 to 23 do not have a portion covering the permanent magnet 31 or 32. Such a layout is possible because the mounting surface 11 is parallel to the X direction, being the stacking direction.

The magnetic rotator 40 includes two ferrite cores 41 and 42 and a central conductor 50 provided therebetween in the X direction. As a material of the ferrite cores 41 and 42, it is preferable to use a soft magnetic material such as yttrium/iron/garnet (YIG). The central conductor 50 has a substantially disk shape, and includes three ports 51 to 53 derived radially from a central point. The central conductor 50 and the ferrite cores 41, 42 are bonded to each other via a bonding layer 71.

A leading end of the first port 51 derived from the central conductor 50 is exposed on the first side surface 13, thereby being connected to the first external terminal 21. A leading end of the second port 52 derived from the central conductor 50 is exposed on the second side surface 14, thereby being connected to the second external terminal 22. Further, a leading end of the third port 53 derived from the central conductor 50 is exposed on the mounting surface 11, thereby being connected to the third external terminal 23.

The non-reciprocal circuit device 10 according to the present embodiment further includes a conductor plate 61 provided between the permanent magnet 31 and the magnetic rotator 40 in the X direction, and a conductor plate 62 provided between the permanent magnet 32 and the magnetic rotator 40 in the X direction. Therefore, the central conductor 50 is provided between the two conductor plates 61 and 62 and is isolated from the permanent magnets 31 and 32. The conductor plates 61 and 62 have a width in the Y direction narrower than the width of the non-reciprocal circuit device 10 in the Y direction, and a height in the Z direction lower than the height of the non-reciprocal circuit device 10 in the Z direction. The conductor plates 61 and 62 are exposed on the upper surface 12, without being exposed from any of the side surfaces 13 and 14 and the mounting surface 11. As described above, because the entire upper surface 12 is covered with the connection conductor 25, conductor plates 61 and 62 are electrically connected to the fourth external terminal 24 via the connection conductor 25. The permanent magnets 31 and 32 and the magnetic rotator 40 are bonded to each other via the bonding layer 72.

Figure 6:
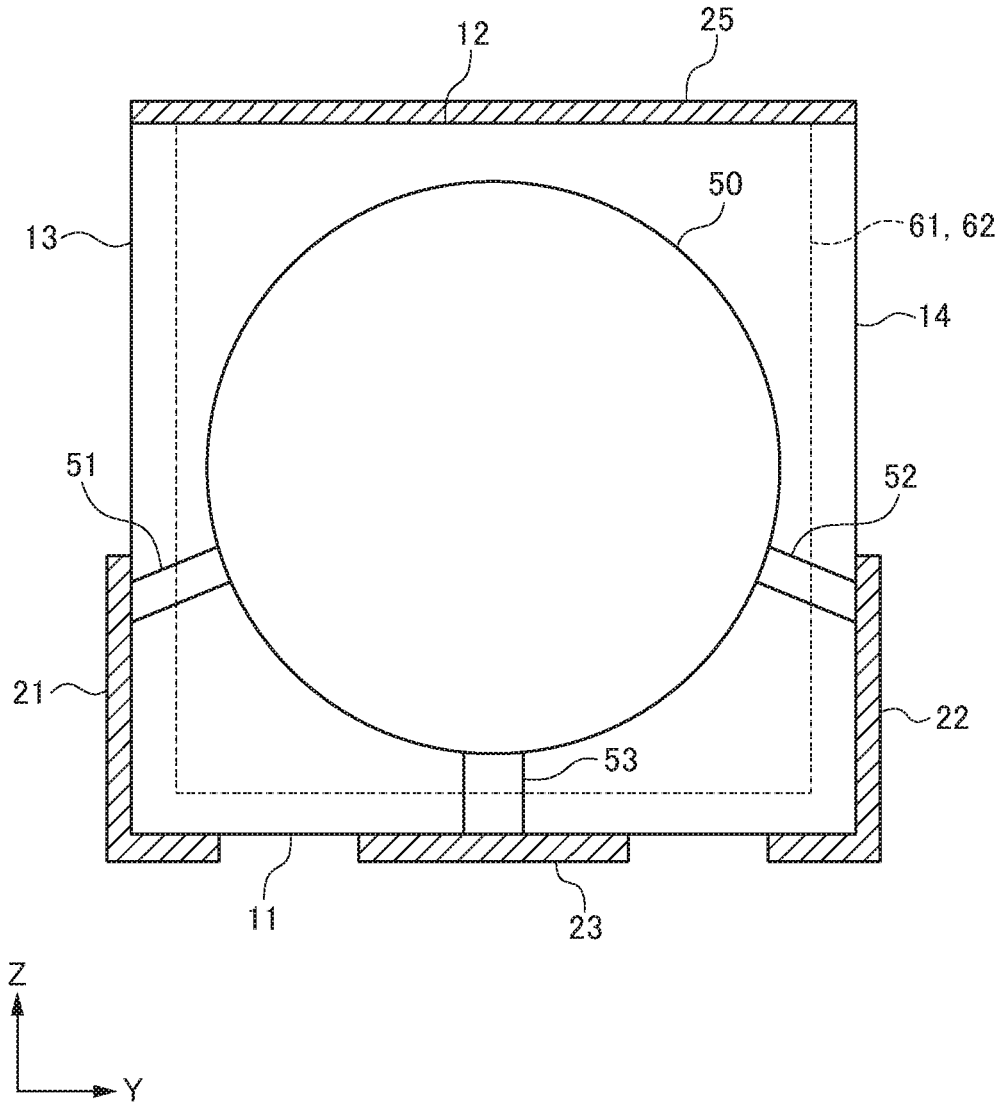
FIG. 6 is a YZ cross-sectional view for explaining a shape of a central conductor.

FIG. 6 is a YZ cross-sectional view for explaining a shape of the central conductor 50.

As shown in FIG. 6, a YZ cross-section of the central conductor 50 is substantially circular. The first port 51 derived from the central conductor 50 extends in a lower left direction in FIG. 6 and is connected to the first external terminal 21. The second port 52 derived from the central conductor 50 extends in a lower right direction in FIG. 6 and is connected to the second external terminal 22. The third port 53 derived from the central conductor 50 extends in a directly downward direction (in a negative Z direction) in FIG. 6 and is connected to the third external terminal 23. However, it is not essential that the YZ cross-section of the central conductor 50 is circular, and can have a concave portion, a convex portion, a hole, a bifurcated branch, or a slit for adjusting the characteristics.

In FIG. 6, positions of the conductor plates 61 and 62 are also shown, and it is understood that end portions of the conductor plates 61 and 62 are not exposed on the mounting surface 11 and the side surfaces 13 and 14. On the other hand, the end portions of the conductor plates 61 and 62 are exposed on the upper surface 12, thereby being connected to the connection conductor 25.

Figure 7:
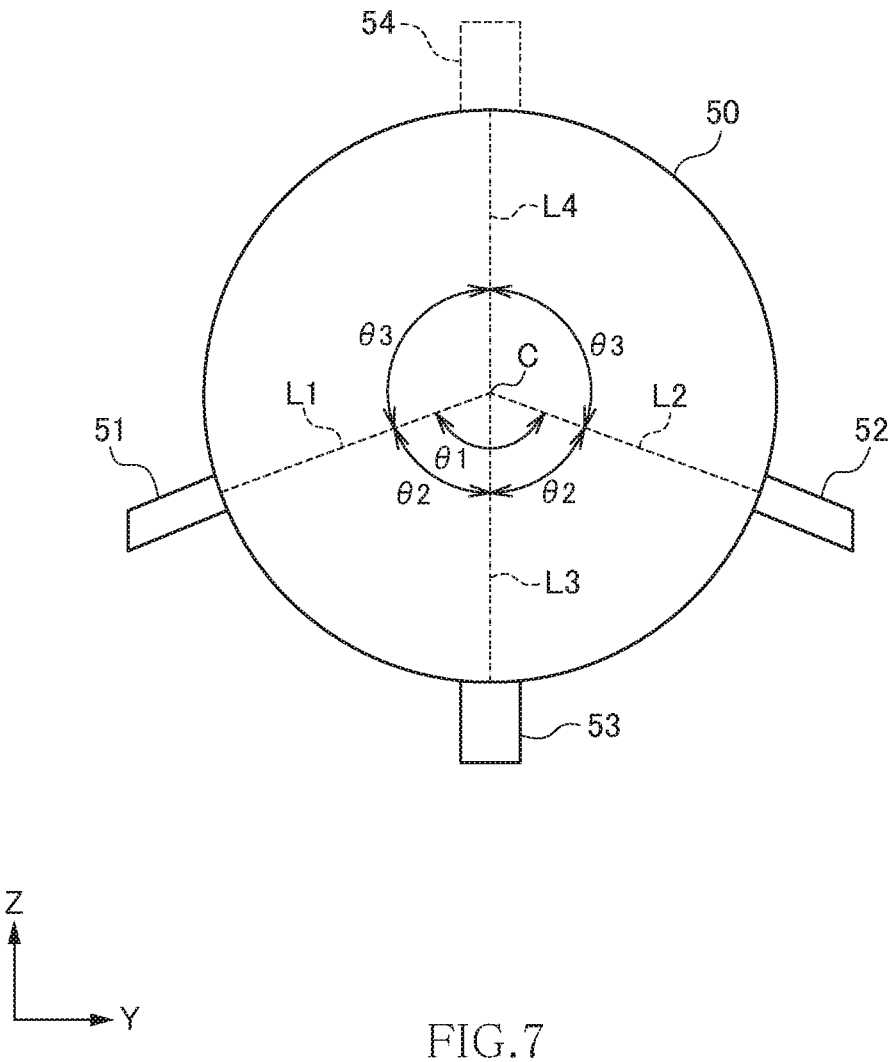
FIG. 7 is a schematic diagram for explaining positions of the ports provided in the central conductor.

FIG. 7 is a schematic diagram for explaining positions of the ports 51 to 53 provided in the central conductor 50.

As shown in FIG. 7, in the present embodiment, when the extending directions of the ports 51 to 53 based on a central point C of the central conductor 50 are indicated respectively by straight lines L1 to L3, an angle θ1 formed between the straight lines L1 and L2 is about 120 degrees, and an angle θ2 formed between the straight lines L1 and L3 and an angle θ2 formed between the straight lines L2 and L3 are respectively about 60 degrees. That is, the angle θ2 is an acute angle, which is largely different from a derivation angle of ports (120 degrees respectively) in a general non-reciprocal circuit device.

The reason why the non-reciprocal circuit device having this configuration functions as a non-reciprocal circuit device is that the third port 53 has substantially the same property as that of a virtual port 54. The virtual port 54 extends in a directly upward direction (a positive Z direction) from the central point C, and angles θ3 formed between a straight line L4 corresponding to the virtual port 54 and the straight lines L1 and L2 are respectively about 120 degrees. That is, the central conductor 50 including the first and second ports 51, 52 and the virtual port 54 has the same configuration as that of the central conductor used in a general three-terminal non-reciprocal circuit device, and as is widely known, the non-reciprocal circuit device functions as an isolator or a circulator.

A standing wave appearing in the virtual port 54 similarly appears in the third port 53 located opposite to the virtual port 54 by 180 degrees. Therefore, by using the third port 53 instead of the virtual port 54, the same function as that of the central conductor used in a general three-terminal non-reciprocal circuit device can be realized. It is not essential that the angle θ1 formed between the straight lines L1 and L2 is exactly 120 degrees, and the angle can be designed to be 120 degrees or more in order to decrease the insertion loss between the first port 51 and the second port 52.

Figure 8:
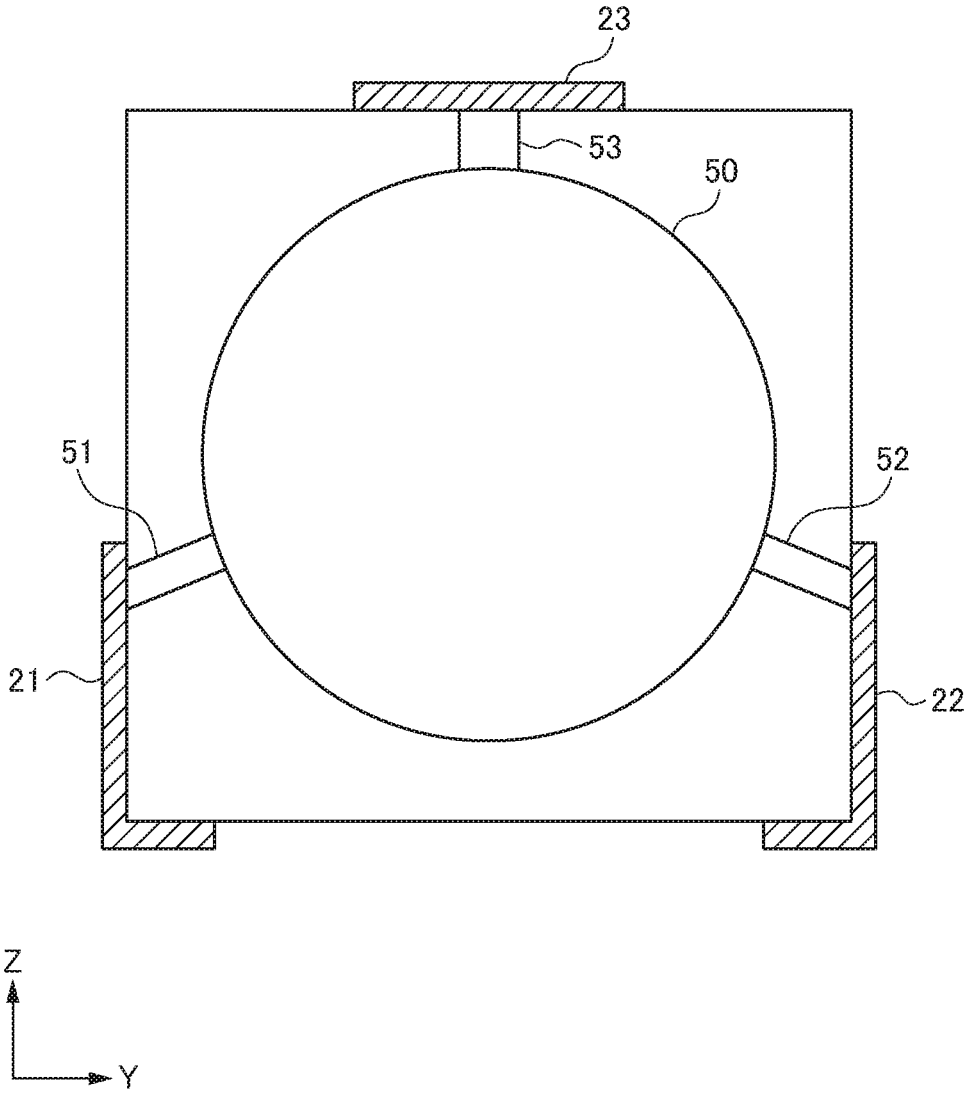
FIG. 8 is a YZ cross-sectional view for explaining a shape of a central conductor according to a first modification.
Figure 9:
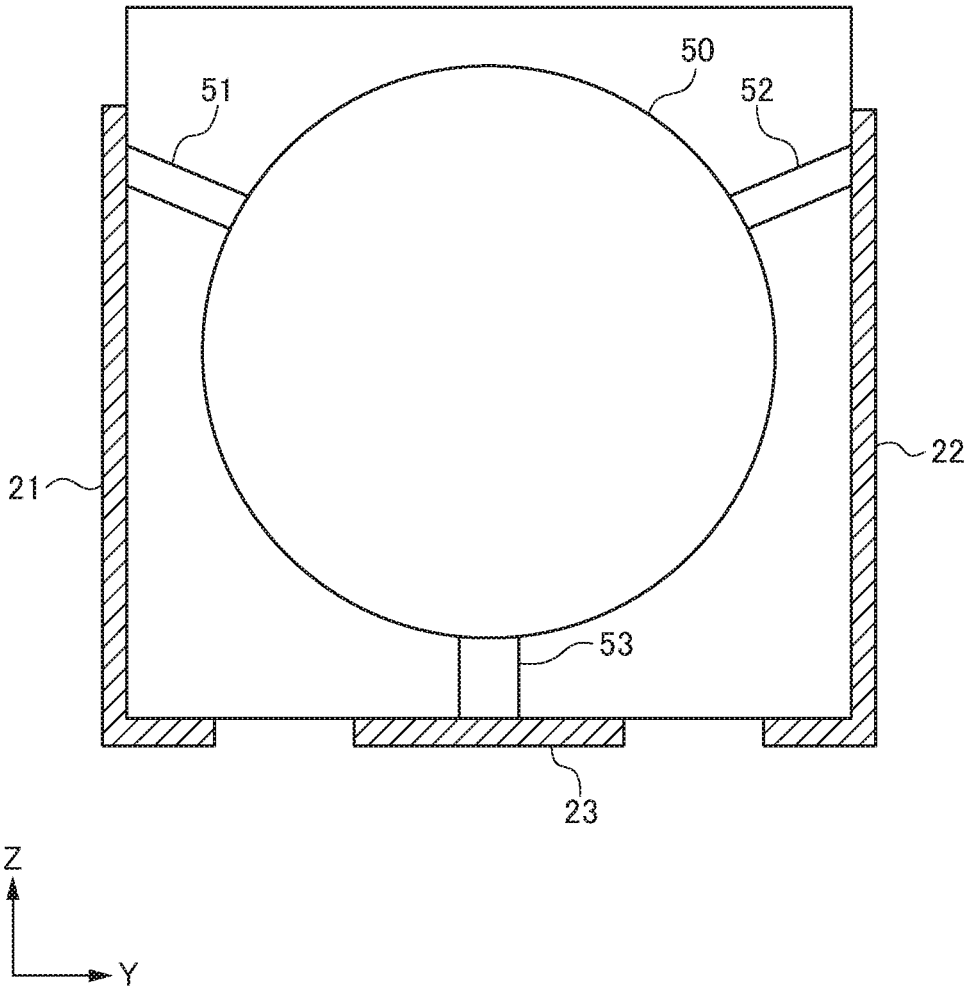
FIG. 9 is a YZ cross-sectional view for explaining a shape of a central conductor according to a second modification.

However, in the present invention, the layout of the ports 51 to 53 derived from the central conductor 50 is not limited to the layout described above. Therefore, as in a first modification shown in FIG. 8, the third port 53 can be arranged at the same position as the virtual port 54. Alternatively, as in a second modification shown in FIG. 9, the layout in the first modification can be rotated by 180 degrees. However, in this case, the length of the first and second external terminals 21 and 22 in the Z direction become long. Therefore, if the frequency band to be used is high, particularly when the non-reciprocal circuit device is used in a frequency band equal to or higher than 20 GHz, the electrical property deteriorates due to inductance components of the first and second external terminals 21 and 22.

On the other hand, according to the layout of the present embodiment shown in FIG. 6, it is not difficult to connect the third port 53 to a land pattern on a printed circuit board, and the length of the first and second external terminals 21 and 22 in the Z direction can be reduced. Therefore, the layout of the central conductor 50 according to the present embodiment can easily adopt a surface-mounted terminal arrangement, and is advantageous when the frequency band to be used is high, particularly when the non-reciprocal circuit device is used in a frequency band equal to or higher than 20 GHz.

In the non-reciprocal circuit device 10 according to the present embodiment, the external terminals 21 to 23 do not overlap on the permanent magnet 31 or 32. Therefore, an inductance of the external terminals 21 to 23 does not increase as in a conventional non-reciprocal circuit device 100 shown in FIG. 14. Accordingly, even if the frequency band to be used is very high, a preferable electrical property can be acquired.

Figure 14:
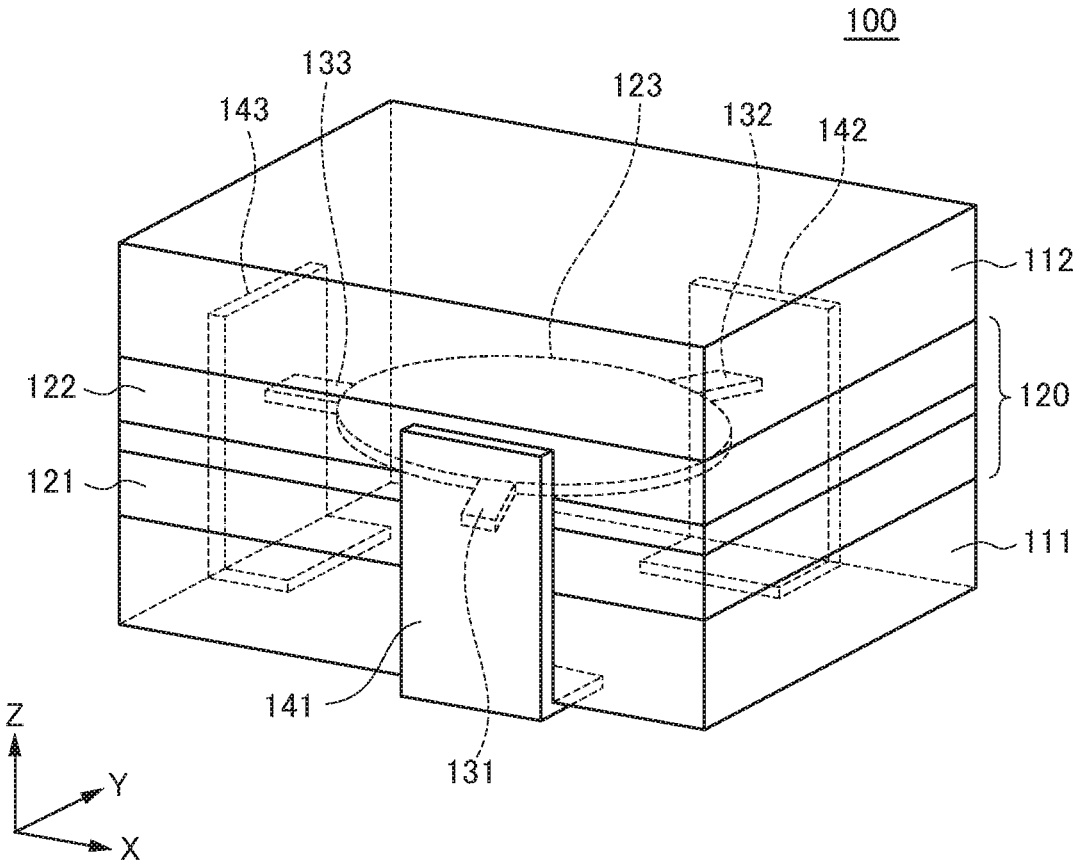
PRIOR ART FIG.14
FIG. 14 is a schematic perspective view showing an example of a conventional multilayered non-reciprocal circuit device.

Table 1 shows electrical properties of the non-reciprocal circuit device 10 according to the present embodiment and the conventional non-reciprocal circuit device 100 shown in FIG. 14. Values indicated in Table 1 are obtained in the case where the length of the non-reciprocal circuit device in the X direction is 2 millimeters, the width thereof in the Y direction is 1.25 millimeters, and the height thereof in the Z direction is 1.25 millimeters, respectively.

TABLE 1

| | | CONVENTIONAL | EMBODIMENT |
|---|---|---|---|
| INSERTION LOSS | 26.5 GHz | 1.87 dB | 0.65 dB |
| | 29.5 GHz | 1.17 dB | 0.62 dB |
| ISOLATION | 26.5 GHz | 12.8 dB | 17.3 dB |
| | 29.5 GHz | 6.8 dB | 23.8 dB |

As shown in Table 1, it is understood that in the non-reciprocal circuit device 10 according to the present embodiment, the insertion loss is low and the isolation property is high in frequency bands of 26.5 GHz and 29.5 GHz, as compared with the conventional non-reciprocal circuit device 100.

Next, a manufacturing method of the non-reciprocal circuit device 10 according to the present embodiment is described.

Figure 10:
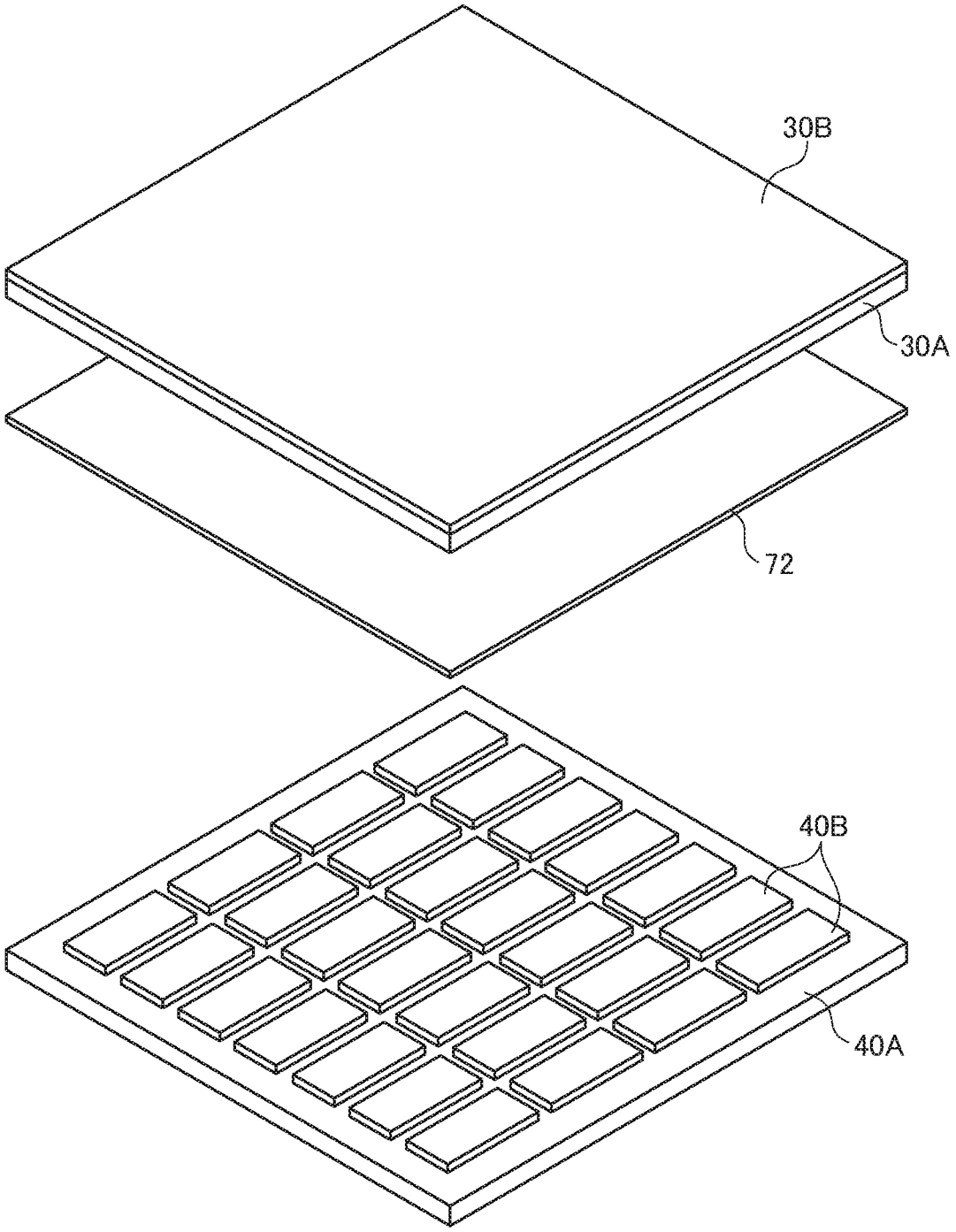
FIG. 10 and FIG. 11 are process diagrams for explaining a manufacturing method of the non-reciprocal circuit device.

First, as shown in FIG. 10, a permanent magnet 30A and a ferrite core 40A are prepared as an aggregate substrate and a conductive pattern is formed on the surfaces of the permanent magnet 30A and the ferrite core 40A. Specifically, a conductive pattern 30B is formed substantially on the whole surface of the permanent magnet 30A, and rectangular conductive patterns 40B are regularly formed on the surface of the ferrite core 40A. As a forming method of the conductive patterns 30B and 40B, for example, a screen printing method can be used. The conductive patterns 40B are portions that eventually become the conductive plate 61 or 62.

Figure 11:
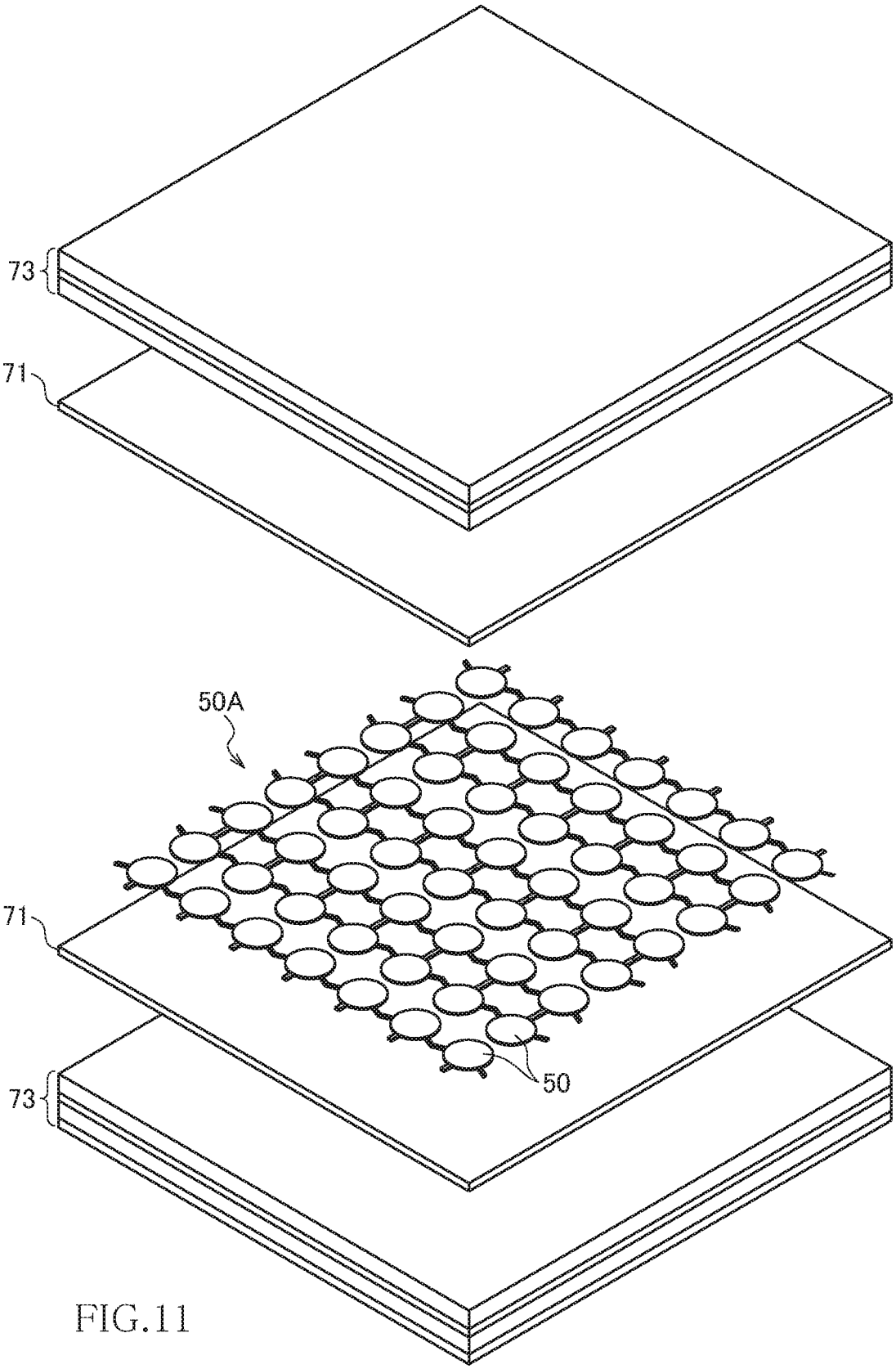

Next, the permanent magnet 30A and the ferrite core 40A are stacked on each other via the adhesive layer 72 and integrated by performing vacuum theremopressing, to manufacture a stacked body 73 shown in FIG. 11. After manufacturing two stacked bodies 73, as shown in FIG. 11, a conductor plate 50A is provided between the two stacked bodies 73 via the bonding layer 71, and these are integrated by performing the vacuum theremopressing. The conductor plate 50A is configured by a plurality of central conductors 50.

Figure 12:
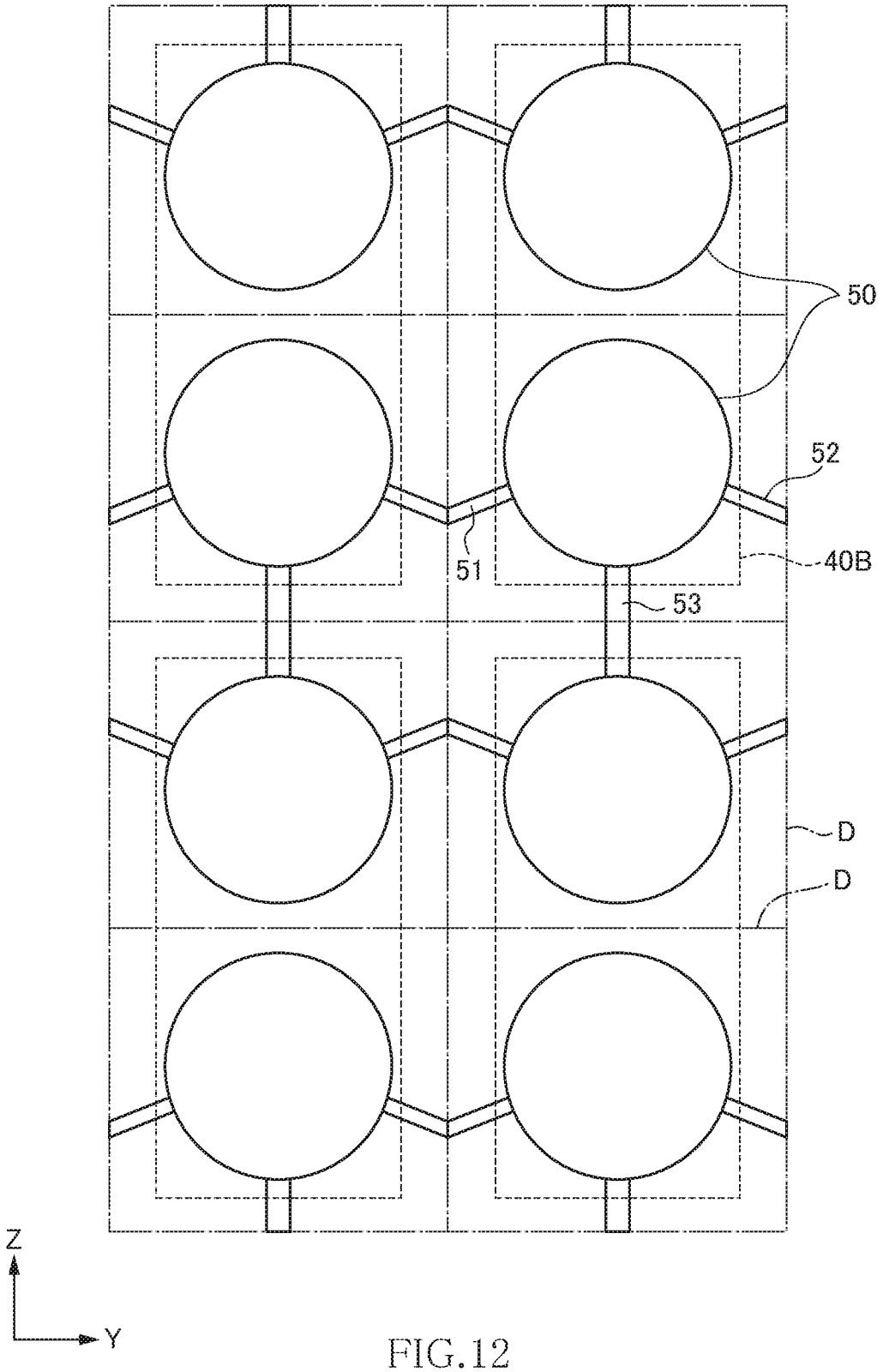
FIG. 12 is a plan view for explaining a positional relation between the conductor pattern and the conductor plate.

FIG. 12 is a plan view for explaining a positional relation between the conductor pattern 40B and the conductor plate 50A. As shown in FIG. 12, the positional relation between them is adjusted so as to overlap one conductor pattern 40B on the two central conductors 50. The central conductors 50 adjacent to each other in the Y direction are coupled by the port 51 or 52, and the central conductors 50 adjacent to each other in the Z direction are coupled by the port 53. Therefore, individual central conductors are not separated from each other.

After the aggregate substrate is diced along a dicing line D shown in FIG. 12, the external terminals 21 to 24 and the connection conductor 25 are formed on each individual piece, to complete the non-reciprocal circuit device 10 according to the present embodiment.

By using such a manufacturing method, a large number of non-reciprocal circuit devices 10 can be manufactured simultaneously, thereby enabling to reduce the manufacturing cost. Further, as shown in FIG. 12, because the conductor pattern 40B overlapping on the two central conductors 50 is used and the conductor pattern 40B is cut in the Y direction, the conductor plates 61 and 62 can be exposed on the upper surface 12.

At the time of mounting the completed non-reciprocal circuit device 10 on the printed circuit board, the non-reciprocal circuit device 10 is mounted in a state in which the non-reciprocal circuit device 10 is rotated by 90 degrees so that the X direction as the stacking direction becomes horizontal. Accordingly, as described above, the external terminals 21 to 23 do not need to intersect the permanent magnet 31 or 32, and thus the high frequency characteristics do not deteriorate as those in the conventional non-reciprocal circuit device 100.

Figure 13:
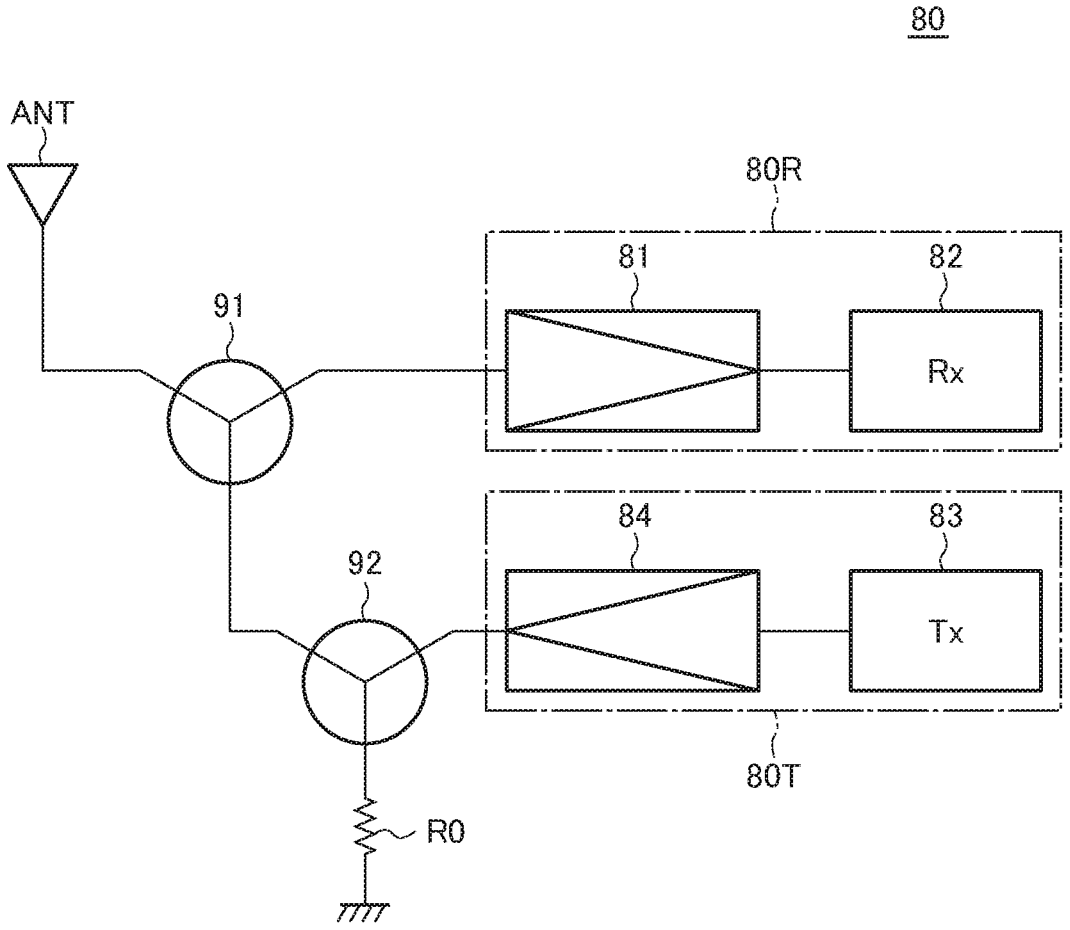
FIG. 13 is a block diagram showing a configuration of a communication apparatus using the non-reciprocal circuit device according to the embodiment.

FIG. 13 is a block diagram showing a configuration of a communication apparatus 80 using the non-reciprocal circuit device according to the present embodiment.

The communication apparatus 80 shown in FIG. 13 is provided in a base station, for example, in a mobile communication system, and includes a reception circuit unit 80R and a transmission circuit unit 80T that are connected to a transmission/reception antenna ANT. The reception circuit unit 80R includes a reception amplifying circuit 81, and a reception circuit 82 that processes a received signal. The transmission circuit unit 80T includes a transmission circuit 83 that generates a speech signal, a video signal, and the like, and a power amplifying circuit 84.

In the communication apparatus 80 having such a configuration, non-reciprocal circuit devices 91 and 92 according to the present embodiment are used in a route from the antenna ANT to the reception circuit unit 80R and a route from the transmission circuit unit 80T to the antenna ANT. The non-reciprocal circuit device 91 functions as a circulator, and the non-reciprocal circuit device 92 functions as an isolator including a termination resistor R0.

It is apparent that the present invention is not limited to the above embodiments, but may be modified and changed without departing from the scope and spirit of the invention.

What is claimed is:

1. A non-reciprocal circuit device comprising:

a mounting surface substantially parallel to a stacking direction;

first and second side surfaces substantially vertical to the mounting surface and substantially parallel to the stacking direction;

a first permanent magnet;

a magnetic rotator including first and second ferrite cores, the magnetic rotator being stacked in the stacking direction with respect to the first permanent magnet, the magnetic rotator having a central conductor and at least first and second ports derived from the central conductor, the central conductor being provided between the first and second ferrite cores in the stacking direction;

a first external terminal provided on the first side surface and connected to the first port; and a second external terminal provided on the second side surface and connected to the second port.

2. The non-reciprocal circuit device as claimed in claim 1, further comprising a magnetic substrate, wherein the magnetic rotator is provided between the first permanent magnet and the magnetic substrate in the stacking direction.

3. The non-reciprocal circuit device as claimed in claim 2, wherein the magnetic substrate comprises a second permanent magnet.

4. The non-reciprocal circuit device as claimed in claim 1, further comprising a third external terminal provided on the mounting surface, wherein the central conductor further includes a third port connected to the third external terminal.

5. The non-reciprocal circuit device as claimed in claim 4, wherein a part of the first external terminal and a part of the second external terminal are provided on the mounting surface.

6. The non-reciprocal circuit device as claimed in claim 4, wherein an angle formed between an extending direction of the first port based on a central point of the central conductor and an extending direction of the third port based on the central point of the central conductor is an acute angle, and wherein an angle formed between an extending direction of the second port based on the central point of the central conductor and the extending direction of the third port based on the central point of the central conductor is an acute angle.

7. The non-reciprocal circuit device as claimed in claim 1, further comprising:

a conductor plate provided between the first permanent magnet and the magnetic rotator in the stacking direction; and a fourth external terminal connected to the conductor plate.

8. The non-reciprocal circuit device as claimed in claim 7, further comprising:

an upper surface located opposite to the mounting surface; and a connection conductor that covers the upper surface, the connection conductor connecting the conductor plate to the fourth external terminal.

9. The non-reciprocal circuit device as claimed in claim 8, wherein the conductor plate is exposed on the upper surface so as to be connected to the connection conductor without exposing from any of the mounting surface, the first side surface, and the second side surface.

10. A communication apparatus includes a non-reciprocal circuit device, the non-reciprocal circuit device comprising:

a mounting surface substantially parallel to a stacking direction;

first and second side surfaces substantially vertical to the mounting surface and substantially parallel to the stacking direction;

a first permanent magnet;

a magnetic rotator including first and second ferrite cores, the magnetic rotator being stacked in the stacking direction with respect to the first permanent magnet, the magnetic rotator having a central conductor and at least first and second ports derived from the central conductor, the central conductor being provided between the first and second ferrite cores in the stacking direction;

a first external terminal provided on the first side surface and connected to the first port; and a second external terminal provided on the second side surface and connected to the second port.

* * * * *